United States Patent [19]

Falterman et al.

[11] 4,157,928

[45] Jun. 12, 1979

[54] METHOD FOR FUEL AIR EXPLOSIVE

[75] Inventors: Charles W. Falterman; James A. Bowen, both of China Lake; Larry H. Josephson, Ridgecrest, all of Calif.

[73] Assignee: The United States of America as represented by the Secretary of the Navy, Washington, D.C.

[21] Appl. No.: 339,662

[22] Filed: Mar. 1, 1973

[51] Int. Cl.[2] ..... C06B 23/00

[52] U.S. Cl. ..... 149/109.2; 149/109.4; 102/90; 252/305

[58] Field of Search ..... 149/109.2, 109.4; 252/305; 102/90

[56] References Cited

U.S. PATENT DOCUMENTS

| | | | |
|---|---|---|---|
| 2,993,768 | 7/1961 | Holzl | 149/109.4 |
| 3,730,093 | 5/1973 | Cummings | 102/6 |

*Primary Examiner*—Stephen J. Lechert, Jr.
*Attorney, Agent, or Firm*—R. S. Sciascia; W. Thom Skeer; L. E. K. Pohl

[57] ABSTRACT

Mixtures of ethylene oxide and propylene oxide are disclosed as being useful as fuels for fuel air explosive weapons.

2 Claims, 1 Drawing Figure

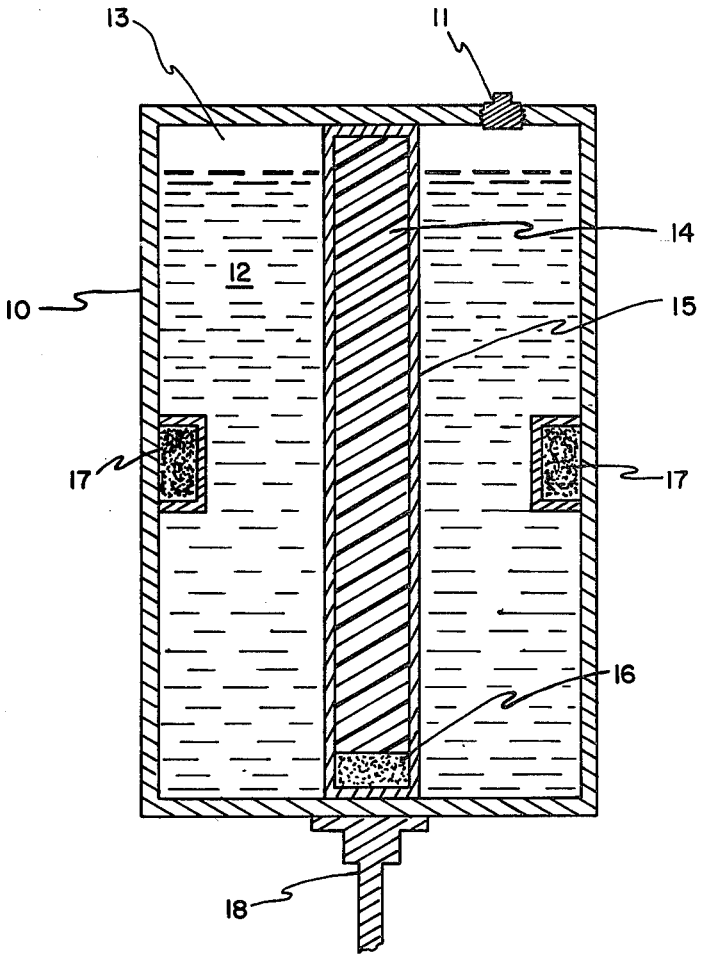
13
11
14
12
10
15
17
17
16
18

METHOD FOR FUEL AIR EXPLOSIVE

BACKGROUND OF THE INVENTION

1. Field of Invention

This invention relates to improved fuels for fuel air explosive weapons and to their use.

2. Description of the Prior Art

Fuel air explosive (FAE) weapons have gained considerable popularity with the military in the recent past. A typical FAE weapon is one which dispenses a plurality of FAE bomblets each of which, upon striking the ground, disperses a cloud of gas and liquid particles. The cloud is formed in a fraction of a second. Then, a plurality of detonators (usually two), which are dispersed along with the cloud, activate and detonate the cloud.

In the prior art, the most effective liquid, from which to form the cloud, has been pure ethylene oxide. However, pure ethylene oxide has certain drawbacks associated with it. First, it has a relatively high vapor pressure (23 psia at 70° F.). Second, it tends to polymerize when stored for long periods of time in a made up bomblet. Third, it is toxic.

The high vapor pressure drawback makes it difficult to load ethylene oxide into a bomblet and necessitates the use of heavy containers for the bomblets in order to prevent the bomblets from rupturing, under vapor pressure, at an inopportune time. The tendency to polymerize under storage conditions necessitates occasional testing of the ethylene oxide and sometimes requires the replacement of and disposal of made up bombs because highly polymerized ethylene oxide will not form a suitable cloud and, consequently, is not useful as a fuel for FAE weapons.

The toxicity, in itself, is a drawback and coupled with the high vapor pressure is doubly so. Because it has such a high vapor pressure, ethylene oxide tends to completely permeate its surroundings. Therefore, one working around large amounts of ethylene oxide must be very careful in order to avoid possible poisoning.

SUMMARY OF THE INVENTION

The above drawbacks associated with pure ethylene oxide are solved herein by replacing ethylene oxide with a mixture of ethylene oxide and propylene oxide. A 50 volume percent ethylene oxide-50 volume percent propylene oxide mixture is preferred because it produces a cloud with good detonation limits. Also, it polymerizes less rapidly and has a lower vapor pressure that ethylene oxide.

BRIEF DESCRIPTION OF THE DRAWING

The single FIGURE is a cross sectional view of a typical FAE bomblet.

DESCRIPTION OF THE PREFERRED EMBODIMENT

Going first to the drawing, which is used for illustrational purposes only, the single FIGURE is a cross sectional view depicting the general appearance of a typical FAE bomblet. An FAE bomblet is usually contained by a scored metallic container 10 which can be tightly sealed by a plug 11 in a manner such that it will withstand pressure on the order of 100 psi or more. The container is partially filled with a fuel 12 leaving a small ullage void 13 to permit the fuel to expand when the bomblet is stored under high temperature conditions.

Centrally located within the container is a core of high explosive 14 which is surrounded by a metallic liner 15 which acts to keep the fuel and high explosive separated. At the forward end of the high explosive core is a booster 16 which is fabricated from an explosive that is more highly sensitive than the explosive of core 14. An example of a suitable booster explosive is tetryl. A plurality of other detonators 17 (usually two) are located opposite each other around the inner periphery of the container about half way between the two ends of the container. The forward end of the bomblet is provided with a probe 18 which, in that portion which is fastened to the bomblet, contains a fuze (not shown) which will activate booster 16 when the probe strikes the ground. The rear or upper end of the bomblet is usually provided with a parachute (not shown) which will act to cause the bomblet to be travelling a predetermined speed when the probe strikes the ground. It will, of course, be realized that there are many different types of fuzes which can be used to activate booster 16 and that almost any high explosive can be used in the high explosive core 14.

When the probe 18 of a bomblet such as that depicted in the drawing contacts the ground, the fuze in the portion attached to the bomblet container activates booster 16. Booster 16, in turn, activates explosive core 14. When explosive core 14 detonates, the bomblet bursts outwardly spreading a cloud of fuel in the air. At the same time, detonators 17 are forced outwardly along with the cloud of fuel and activate after cloud formation. They actually detonate the cloud approximately 125 milliseconds after the explosion of the central explosive core has taken place.

When 70 pounds of pure ethylene oxide is used as the fuel in a bomblet approximately 12 inches in diameter by 18 inches in height, a cloud approximately 20 feet in radius and approximately 9 feet in thickness is formed. The cloud contains regions of about 6% or higher concentration of fuel per unit volume of air with the amount of fuel being smaller near the center of the cloud and larger near the outer edge or circumference of the cloud. If, for some reason, the concentration of fuel exceeds 21% or is smaller than 5% in a large portion of the cloud, the cloud will not detonate but will merely burn. If the fuel in the bomblet is too viscous, the correct volume percentage range for the fuel will not be achieved and the cloud will not detonate. This is one of the problems solved by the present invention.

Pure ethylene oxide, as stated above, tends to polymerize when stored over a long period of time. Data indicates that bomblets loaded with a 50% propylene oxide and 50% ethylene oxide mixture are useful after a storage period of twice that possible for pure ethylene oxide.

When a bomblet containing a 50 volume pecent ethylene oxide-50 volume percent propylene oxide mixture is initiated, the concentration of fuel in the cloud ranges from near 5% by volume to slightly higher. This concentration has been found suitable to permit detonation.

A further improvement of the 50/50 mixture over pure ethylene oxide resides in the fact that the 50/50 mixture has a lower vapor pressure than pure ethylene oxide. The mixture has a vapor pressure of 14.5 psia while the ethylene oxide has 23 psia. Both the 50/50 mixture and pure ethylene oxide are gases at room temperature and under atmospheric pressure. Accordingly, they are stored at low temperatures to keep them liquid prior to being loaded into bomblets. Then, after they have been loaded at a low temperature (approximately 0° C.), their confinement in the closed container serves to keep them liquid. With ethylene oxide, because of its high vapor pressure, a thick walled, heavy container must be used in order to insure that the container will not accidently burst under the vapor pressure exerted by the ethylene oxide. But on the other hand, a lighter container may be safely used with a 50/50 ethylene oxide-propylene oxide mixture. This, of course, permits more bomblets to be loaded into a delivering aircraft as long as weight only and not space is the consideration.

According to this invention, a range of from 100% propylene oxide and 0% ethylene oxide down to a 50/50 mixture could be used with the 50/50 mixture being preferred. An 100% propylene oxide fuel has detonation limits of 5 to 9.5% by volume, and a cloud with these limits is sometimes hard to detonate. On the other hand, the detonation limits of a 50/50 mixture range from about 5 to 17% by volume. In other words, the concentration of liquid particles produced by a 50 volume percent ethylene oxide-50 volume percent propylene oxide mixture is preferable over those produced by mixtures having a larger amount of propylene oxide and over pure propylene oxide because of its better detonation limits. Mixtures according to this invention can be made up by pouring either of the oxides into the other at a temperature of approximately 0° C. or lower.

As used in this disclosure, the term concentration per unit volume of air means that if all the fuel (droplets as well vapor) in a unit volume of air were to become vaporized, the vapor would form whatever percentage is given. In other words, with a concentration of 6% fuel, one cubic meter of gases in the cloud would be made up of 6% fuel and 94% air by volume if all the fuel were vapor.

What is claimed is:

1. A method for creating a detonation, said method comprising the steps of:

(a) dispersing in the air, by means of an explosion, a cloud of liquid droplets, approximately 50% of said droplets being ethylene oxide and approximately 50% of said droplets being propylene oxide; and (b) detonating said cloud of droplets by means of detonators which are dispersed with said cloud of droplets by said explosion.

2. A method according to claim 1 where the concentration of said cloud of liquid droplets in the air is in the range of from about 5 to about 17% per unit volume of air.

* * * * *